US011813766B2

(12) United States Patent
Staudinger et al.

(10) Patent No.: US 11,813,766 B2
(45) Date of Patent: Nov. 14, 2023

(54) PUNCHING/PERFORATION MACHINE AND PROCESSING SYSTEM COMPRISING A FRAME MECHANISM FOR CLAMPING THE MATERIAL UNIT

(71) Applicant: WISTA Werkzeugfertigungs-GmbH, Bad Rappenau (DE)

(72) Inventors: Gerd Staudinger, Eppingen (DE); Alexander Fuchs, Sinsheim (DE)

(73) Assignee: WISTA Werkzeugfertigungs-GmbH, Bad Rappenau (DE)

( * ) Notice: Subject to any disclaimer, the term of this patent is extended or adjusted under 35 U.S.C. 154(b) by 137 days.

(21) Appl. No.: 17/601,097

(22) PCT Filed: Apr. 1, 2020

(86) PCT No.: PCT/DE2020/000071
§ 371 (c)(1),
(2) Date: Nov. 22, 2021

(87) PCT Pub. No.: WO2020/200345
PCT Pub. Date: Oct. 8, 2020

(65) Prior Publication Data

US 2022/0111544 A1 Apr. 14, 2022

(30) Foreign Application Priority Data

Apr. 5, 2019 (DE) ..... 20 2019 001 572.8

(51) Int. Cl.
*B26D 5/12* (2006.01)
*B26F 1/04* (2006.01)
(Continued)

(52) U.S. Cl.
CPC ..... *B26D 5/12* (2013.01); *B26F 1/04* (2013.01); *B26F 1/24* (2013.01); *B26D 2005/002* (2013.01)

(58) Field of Classification Search
CPC ..... B26D 5/12; B26D 2005/002
(Continued)

(56) References Cited

U.S. PATENT DOCUMENTS 3,237,242 A * 3/1966 Gerletz ..... B29C 51/445 226/162
5,204,913 A * 4/1993 Morooka ..... B26D 5/007 382/296
(Continued)

FOREIGN PATENT DOCUMENTS

DE 3339503 A1 5/1985
DE 4135787 A1 5/1992
(Continued)

OTHER PUBLICATIONS

Gerd Staudinger, co-pending U.S. Appl. No. 17/601,124, filed Oct. 4, 2021.

*Primary Examiner* — Omar Flores Sanchez
(74) *Attorney, Agent, or Firm* — Smartpat PLC

(57) ABSTRACT

A punching/perforation machine creates a predefined punching/perforation pattern in a material that is supplied in a direction of travel. The machine comprises a punching/perforation tool that includes an upper tool part which can be moved in a direction of stroke and which is equipped with a plurality of punching dies/perforation needles that are arranged in a predefined grid in a transverse direction and can be moved by a pressure beam that is operatively connected to a drive unit via a control device in order to produce a punching/perforation stroke. The material is supplied between the upper tool part and a lower tool part. The material is placed or clamped in a frame mechanism. The punching/perforation machine includes a frame accommodation/connection device for accommodating/connecting the frame mechanism, and the frame mechanism containing
(Continued)

the material is supplied between the upper tool part and the lower tool part.

20 Claims, 10 Drawing Sheets

(51) Int. Cl.
*B26F 1/24* (2006.01)
*B26D 5/00* (2006.01)

(58) Field of Classification Search
USPC ..... 83/76.1
See application file for complete search history.

(56) References Cited

U.S. PATENT DOCUMENTS 5,357,446 A * 10/1994 Maeda ..... B21D 28/26 700/182
6,062,120 A * 5/2000 Tsuzaki ..... B26D 9/00 83/687
6,951,177 B2 * 10/2005 Fischer ..... D05B 3/08 112/68
7,065,478 B2 * 6/2006 Liu ..... G06F 30/17 703/7
2003/0226486 A1 * 12/2003 Filges ..... D05B 37/04 112/65
2014/0298968 A1 * 10/2014 Hirosawa ..... H01L 21/78 83/39

FOREIGN PATENT DOCUMENTS

DE 202005010990 U1 9/2005
DE 202014104997 U1 12/2014
DE 202017103498 U1 7/2017
DE 202019000468 U1 2/2019
JP 2002355796 A 12/2002
WO 2019202637 A1 10/2019

* cited by examiner 10.1
128
129
128
129
128
128
128

PUNCHING/PERFORATION MACHINE AND PROCESSING SYSTEM COMPRISING A FRAME MECHANISM FOR CLAMPING THE MATERIAL UNIT

TECHNICAL FIELD

The present disclosure relates to a punching/perforating machine for generating a predefinable punching/perforation pattern in a material unit. The present disclosure furthermore relates to a processing installation comprising such a punching/perforating machine in a first processing station and further processing stations for the material unit.

BACKGROUND

DE 33 39 503 A1 discloses a punching machine having a plurality of stamping punches, which each interact with a female die, a drive device for the stamping punch movements and a feed device for moving the material to be punched cyclically onward through the punching machine. In at least one of the stamping punches, preferably in all of the stamping punches, an individual drive that can be switched on and off and/or a coupling to the drive device that can be switched on and off is provided. The punching machine furthermore comprises a machine table having a plurality of receiving positions for a respective tool unit. The tool unit has at least one female die and at least one stamping punch which can be acted on by the drive device. The tool unit comprising the female die and a stamping punch interacting with the female die comprises an individual drive that can be switched on and off or a coupling device that can be switched on and off for the transmission of the stamping punch drive force.

DE 41 35 787 A1 describes a punch processing apparatus for producing a punching pattern, comprising an upper die with a stamping punch holder having a plurality of stamping punches and with a stripper plate located underneath with holes for receiving the ends of the stamping punches projecting from the stamping punch holder, in such a way that they can be extended or retracted, and a lower die with holes into which the ends of the stamping punches enter during the punching operation. Feed devices move a material unit, which is introduced between the lower die and the stripper plate, intermittently and synchronously with the punching operation. The stamping punches are retained in the stamping punch holder such that they can be moved upward and downward, wherein the upper sides of heads of the stamping punches end smoothly or with the upper surface of the stamping punch holder. In this case, press heads are used with a head surface for pressing down the stamping punch heads. In addition, a stepped portion preventing pressing down is movable by press head drive devices in such a way that either the head surface or the blunted portion is aligned with the respective stamping punch head. The press head drive devices are controlled by a control circuit, which generates binary-coded processing data according to the punching pattern.

German utility model specification DE 20 2005 010 990 U1 describes an apparatus for punching workpieces, comprising an upper tool and a lower tool, wherein the upper tool is movable relative to the lower tool, wherein a plurality of stamping punches and actuating elements assigned thereto are arranged in the upper tool and are adjustable between an actuating position, in which the stamping punches process the workpiece during a movement of the upper tool relative to the lower tool, and a not actuating position, in which the stamping punches do not process the workpiece during a movement of the upper tool relative to the lower tool, and wherein the upper tool comprises a first, upper punch guide plate with holes for the punches to be guided through and a second punch guide plate, facing the lower tool, with holes for the punches to be guided through. Furthermore, a second punch guide plate, facing the lower tool, of the upper tool is part of a hold-down element, wherein the friction of the stamping punches within the holes of the hold-down element is higher than within the holes of the upper punch guide plates of the upper tool.

German utility model specification DE 20 2017 103 498 U1 discloses a perforating machine comprising a machine table and a striking element which is movable relative thereto, comprising a perforating tool, which is accommodated either on the machine table or on the striking element and which is assigned a female die on the respective other part, for perforation of a material web that is guided such that it can be driven in its longitudinal direction between the perforating tool and the female die. Additionally provided are means for the simultaneous movement of the perforating tool and the female die in the transverse direction relative to the material web.

German utility model specification DE 20 2014 104 997 U1 describes a punch having a plurality of stamping punches, the punch heads of which are mounted in a punch receiving plate. The mounting of the punch heads in the punch receiving plate is designed in such a way that an undercut is produced during the reverse stroke of the stamping punches, wherein a drive element moves the punch receiving plate indirectly. The punch has at least one locking element, which is assigned to at least one stamping punch and is located between the drive element and the punch receiving plate. The locking element is movable into two operating positions, wherein, in a first operating position, the locking element fills the interspace between the drive element and the punch head of the at least one stamping punch and, in a second operating position, the locking element forms a clearance above the punch head of the at least one stamping punch and wherein, in addition, the at least one stamping punch is retained by a braking element, at least in the second operating position of the locking element.

Furthermore, in the known punching/perforating machines, the spacing between the stamping punches/perforating needles is relatively large on account of the selected geometry, such that punching/perforation patterns with a small grid size cannot be generated.

The number of needles in the known punching/perforating machines is therefore significantly limited per unit area.

Furthermore, it should be noted with respect to the known punching/perforating machines that the cycle rate with respect to the punching/perforation strokes to be carried out is relatively low on account of the mechanically selected designs, which increases the processing time in the production process. This has a negative effect on the economical use of such punching/perforating machines.

German utility model DE 20 2019 000 468 discloses a punching/perforating machine which is equipped with the following features, namely a punching/perforation tool having a plurality of stamping punches/perforating needles which are arranged in a predefined grid in a longitudinal direction and which are movable by means of a pressure beam which is operatively connected via a control device to a drive unit for generating a punching/perforation stroke transversely to the longitudinal direction, a control block for actuation/activation/deactivation of the stamping punches/perforating needles by the control device during the punching/perforating operation, and distinguished in that the punching/perforation tool and/or the control block is/are in each case formed as a separate subassembly, which is/are in each case arranged within the punching/perforating machine so as to be removably fastenable separately as a unit. In this punching/perforating machine, the material unit/web is cyclically supplied in the transport direction prior to each punching/perforation stroke and the punching or perforation is carried out, wherein the individual stamping punches/perforating needles to be activated per stroke for the punching/perforating operation can be individually activated or deactivated. On account of the cyclic supply of the material unit/web, the possible perforation patterns are predetermined by the design specifications of this machine.

For the processing of material units in known punching/perforating machines, a rough cut-to-size portion of the material unit is initially produced. The material unit is then aligned on a paper support on the machine table of the punching/perforating machine and supplied to the punching/perforation tool. As a result of the use of a paper support, there is a high quantity of consumable and the punching/perforation tool and the stamping punch/perforating needle are exposed to a relatively high level of wear. Thereafter, the produced punching/perforation pattern is checked and the outer contour of the perforated/punched material unit in a fine cut-to-size portion is adapted to the final peripheral geometry. In addition, holes are punched into the edge region, which are used to be able to clamp the material unit in a frame which is supplied, in a further processing operation, to a sewing machine which produces, for example, decorative seams or connection seams. These processing operations are very time-intensive and sometimes lead to inaccuracies which have a negative effect on the visual appearance of the processed material unit.

SUMMARY

The present disclosure is based on the object or the technical problem of specifying a punching/perforating machine of the type mentioned in the introduction which permits economical production and the generation of an exact punching/perforation pattern, for which there is no elaborate postprocessing, and which ensures high variability with respect to a possible punching/perforation pattern, guarantees high cycle rates, ensures permanently reliable functioning and enables high service lives and can be readily incorporated in a processing installation with further processing stations.

The punching/perforating machine according to the invention is provided by the features of independent claim 1. Advantageous refinements and developments are the subject matter of the claims which are directly or indirectly dependent on independent claim 1.

The punching/perforating machine for generating a predefinable punching/perforation pattern in a material unit supplied in a transport direction, comprises a punching/perforation tool having a tool upper part, which is movable in a stroke direction and which has a plurality of stamping punches/perforating needles which are arranged in a predefined grid in a transverse direction and which are movable by means of a pressure beam which is operatively connected via a control device to a drive unit for generating a punching/perforation stroke, and a stationary tool lower part/female die, wherein the material unit is supplied between the tool upper part and the tool lower part.

The punching/perforating machine is distinguished in that the material unit is arranged or clamped in a frame apparatus, the punching/perforating machine comprises a frame accommodation/connection device for accommodation/for connection of the frame apparatus, wherein the frame apparatus with material unit is supplied between the tool upper part and the tool lower part for perforation/punching of the material unit.

A particularly preferred refinement is distinguished in that the frame apparatus comprises a changeable frame having fixing units for connection/for clamping of the edge region of the material unit in the changeable frame.

An advantageous development is distinguished in that the frame apparatus comprises a cover frame which is arranged on/connected to the changeable frame to secure the connection of the edge region of the material unit.

According to the method, in the context of the processing of the material unit, which is supplied to a punching/perforation tool, the following operations are performed: first, the outer contour of the material unit is produced in the finished size. Continuous apertures are additionally produced in the outer edge region of the material unit. This preprocessed material unit is then mounted on fixing units of the changeable frame and secured by means of a cover frame. As a result, the material unit is aligned accurately in terms of position. The changeable frame with material unit is then supplied to the punching/perforation tool to produce the punching/perforation pattern. After the punching/perforation pattern has been produced, the changeable frame is inserted or integrated with an exact fit into a transport frame/holder for material to be sewn and is inserted without any further modification in a sewing machine, which performs further processing, or the like.

As a result, the time-consuming realignment of the respective machine and the resultant inaccuracies are obviated. Moreover, a work step in the cutting-to-size process is omitted compared with the previous methods, since the outer contour can already be produced in the finished size and no subsequent correction is required on account of the exact positioning of the material unit in the changeable frame. Further system-related work steps can be readily integrated in machines which are incorporated in this work sequence.

A rapid change of the product is also possible because during processing by the machine the changeable frames can in the meantime be separately loaded outside. The same also applies for a model change during production.

A particularly preferred advantageous refinement, which ensures high variability with respect to the implementation of a wide variety of different punching/perforation patterns, is distinguished in that means for generating a simultaneous relative movement of the supplied frame apparatus with material unit relative to the punching/perforation tool to a predefinable extent both in the transport direction and in the transverse direction are present, such that the frame apparatus with material unit is positionable, prior to each punching/perforation stroke, in an individual predefinable position relative to the punching/perforation tool.

By virtue of the fact that the means for generating a simultaneous relative movement of the material unit can be used to bring the material unit into any desired predefinable position prior to the punching/perforating operation, a wide variety of different punching/perforation patterns which are not possible with the hitherto known punching/perforating machines can be made possible, wherein at the same time a high cycle rate and permanently reliable functioning can be ensured.

In contrast to the machines known in the prior art, it is not the punching/perforation tool that is displaced but rather merely the material unit or the receiving unit thereof, which requires considerably lower forces, thus permits faster cycle rates and prevents increased wear.

A particularly preferred refinement of the punching/perforating machine is distinguished in that the means comprise a first drive unit, which brings about a movement of the material unit in the transport direction, and a second drive unit, which brings about the movement of the material unit in the transverse direction.

A particularly advantageous development, which ensures economical production while simultaneously ensuring permanently reliable functionality and service life, is distinguished in that the first drive unit and the second drive unit are each formed as a servomotor.

A reliably advantageous refinement which is particularly simple in terms of design is distinguished in that the drive units are connected via coupling members to the material unit.

An advantageous refinement is distinguished in that a memory device is present, in which the data for the geometry of the punching/perforation pattern with respect to position and diameter is stored, the control device is communicatively connected to the memory device, the control device is operatively connected to a control block of the stamping punches/perforating needles for actuation/activation/deactivation of the stamping punches/perforating needles during the punching/perforating operation, the control device is communicatively connected to the means for generating a simultaneous relative movement of the material unit and the control device initiates the corresponding activation of the means in dependence on the data stored in the memory device.

With regard to the variation of the design of the visual appearance of the punching/perforation pattern, a particularly advantageous refinement is distinguished in that the punching/perforation tool comprises stamping punches/perforating needles having different diameters.

A refinement which is particularly advantageous in terms of design, and which permits high cycle rates and at the same time permits individual configuration of the punching/perforation pattern, is distinguished in that a control block is present, which comprises piston-cylinder units whose movements during the punching/perforation stroke are individually actuable via the control device and are individually assigned to each stamping punch/each perforating needle, a blocking slide, which is connected in each case to a corresponding piston rod of the piston-cylinder unit, wherein the blocking slide is displaceable into an activation or deactivation position by the movement of the piston rod, in the activation position, the blocking slide acts directly or indirectly on the stamping punch/the perforating needle during the execution of the stroke, in the deactivation position, the blocking slide does not exert any action on the stamping punch/the perforating needle, such that, in the activation position of the blocking slide, the latter acts on the stamping punch/perforating needle during the stroke movement and a perforation is carried out and, in the deactivation position of the blocking slide, no punching/perforation of the material unit is effected.

According to a preferred development, it has proven to be particularly advantageous for the punching/perforating machine to be designed such that the piston-cylinder unit is formed as a double-acting piston-cylinder unit having a first pressure chamber and a second pressure chamber, wherein a first pressure is applied permanently to the first pressure chamber via the control device and has the effect that the blocking slide is located or retained in the deactivation position and, when carrying out punching or perforation, the control device applies a second pressure, which is higher than the first pressure, to the second pressure chamber when activated, such that the blocking slide moves out into the activation position and, as a result, during the stroke movement, this movement is transmitted to the associated stamping punch/perforating needle, such that punching or perforation of the material unit is carried out.

As a function of the system, only fixed predefined grids with respect to the punching/perforation pattern are possible as a result of the mechanical structure of known punching/perforating machines. By virtue of the fact that the material unit can be positioned in different directions relative to the punching/perforation tool, possibilities are opened up to implement perforation patterns that have hitherto not been possible. This results in a virtually unlimited representation of punching/perforation patterns desired in terms of design. Proceeding from the hitherto developed parts for controlling the pattern of the punching/perforating machine, the means for carrying out the movement of the material unit can be readily incorporated. This applies not only to individual material units to be perforated but also during the perforation of roll goods, wherein the complete transport of the material to be perforated in the transport direction and in the transverse direction is correspondingly implemented by the movement means in conjunction with the control device and memory device. Furthermore, there is the possibility of carrying out punching using different punches or perforating needles having different diameters in the same work step. The punches/perforating needles of different diameter are only actuated or activated according to the actuation signals of the control device in relation to the desired pattern image.

A processing installation for the standardized processing, in particular punching, embossing, sewing or the like, of material units, in particular made of leather, synthetic leather, films, paper or the like, is characterized by a first processing station, which comprises a punching/perforating machine as disclosed above, to which a respective standardized frame apparatus with material unit is supplied for generation of a predefined punching/perforation pattern, and a second processing station to which the frame apparatus with perforated/punched material unit is supplied and which further processes the latter.

A preferred refinement is distinguished in that the second processing station comprises a sewing machine having a transport frame/holder for material to be sewn, into which the frame apparatus with perforated material unit is introduced, and the material unit is provided with decorative seams and/or connection seams.

Further processing stations may also be present, by means of which the frame apparatuses with processed material unit coming from the second processing station are subjected to further processing.

A particularly preferred refinement of the processing installation is distinguished in that present upstream and downstream of the individual processing stations are intermediate stores in which the frame apparatuses with material units are stored, which are successively removed and supplied to a processing station or, coming from a processing station, are stored in the intermediate store.

With regard to an automated processing sequence, economical production can be made possible in that controllable handling units are present, which remove the frame apparatuses from the intermediate stores and supply them to the processing stations and, after processing, deposit them into the corresponding intermediate stores.

The handling units may be formed in this case as automatically operating robot units having gripper units, which are actuated by a central control device.

In the context of an economical manufacturing operation, it is particularly advantageous according to a particularly advantageous development that the frame apparatus comprises an electronically readable information unit which contains specific information for the respective punching/perforation pattern of the clamped material unit and/or specific information for the further processing of the frame apparatus with material unit. The same information units can be read for example by the handling units or at the individual processing stations, as a result of which the processing stations then carry out the corresponding individual processing of the respectively currently supplied frame apparatus with material unit.

Further embodiments and advantages of the invention emerge from the features further listed in the claims and also from the exemplary embodiments specified below. The features of the claims may be combined with one another in any desired way, provided they are not obviously mutually exclusive.

BRIEF DESCRIPTION OF THE DRAWINGS

The invention and advantageous embodiments and developments thereof are described and explained in more detail below on the basis of the examples illustrated in the drawing. The features apparent from the description and the drawing may be applied individually on their own or multiply in any desired combination in accordance with the invention. In the drawing.

DETAILED DESCRIPTION

Figure 1:
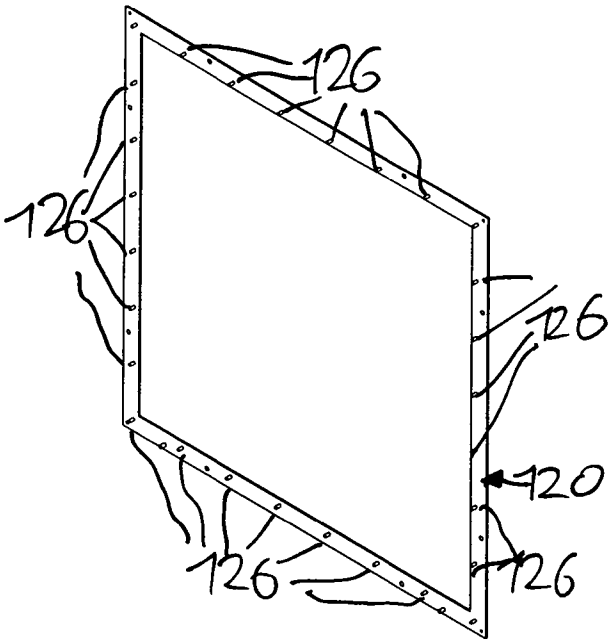
FIG. 1 shows a perspective illustration of a changeable frame.

FIG. 1 shows a perspective of an exemplary embodiment of a flat changeable frame 120, which has a square peripheral contour in the exemplary embodiment. In the peripheral direction, fixing units 126 which are arranged in a grid-like manner and which are used to be able to connect, and thus exactly position, a material unit M to be processed (see FIGS. 2 and 3) are present on the changeable frame 120.

Figure 2:
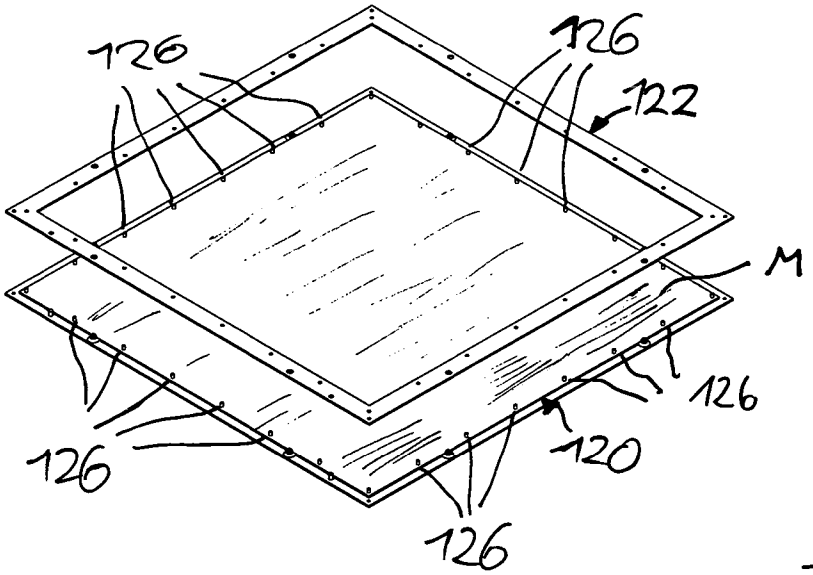
FIG. 2 shows a perspective illustration of a changeable frame with material unit and cover frame in an exploded illustration.

FIG. 2 shows the changeable frame 120 with connected material unit M and, above that, in an illustration pulled apart from each other, a cover frame 122 which has substantially the same peripheral contour as the changeable frame 120 and can be plugged onto the latter for additional securing of the material unit M. In the plugged-on state as per FIG. 3, the two frames 120, 126 form a frame apparatus 130 with a material unit M fixed in a positionally accurate manner on the inner side.

This frame apparatus 130 is supplied to a punching/perforating machine 10 for generation of a predefined punching/perforation pattern on the material unit M, which is illustrated in more detail in FIGS. 6, 7, 8 and 9 and is described further below.

The changeable frame 120 and the cover frame 122 may be made of metal or plastic, for example.

Figure 4:
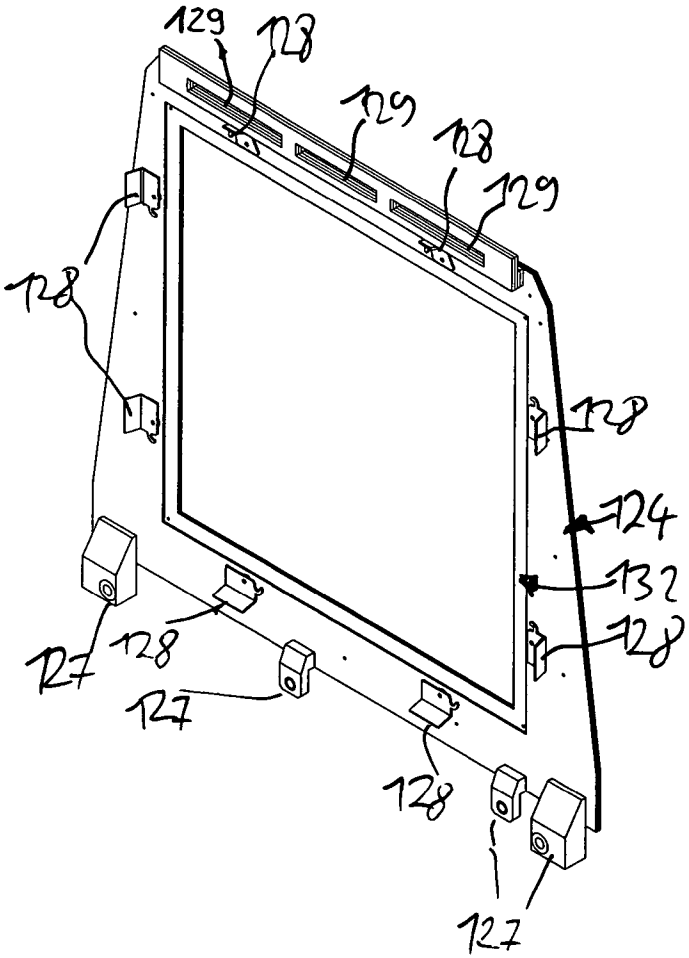
FIG. 4 shows a perspective illustration of a transport frame (holder for material to be sewn) for a sewing machine.
Figure 5:
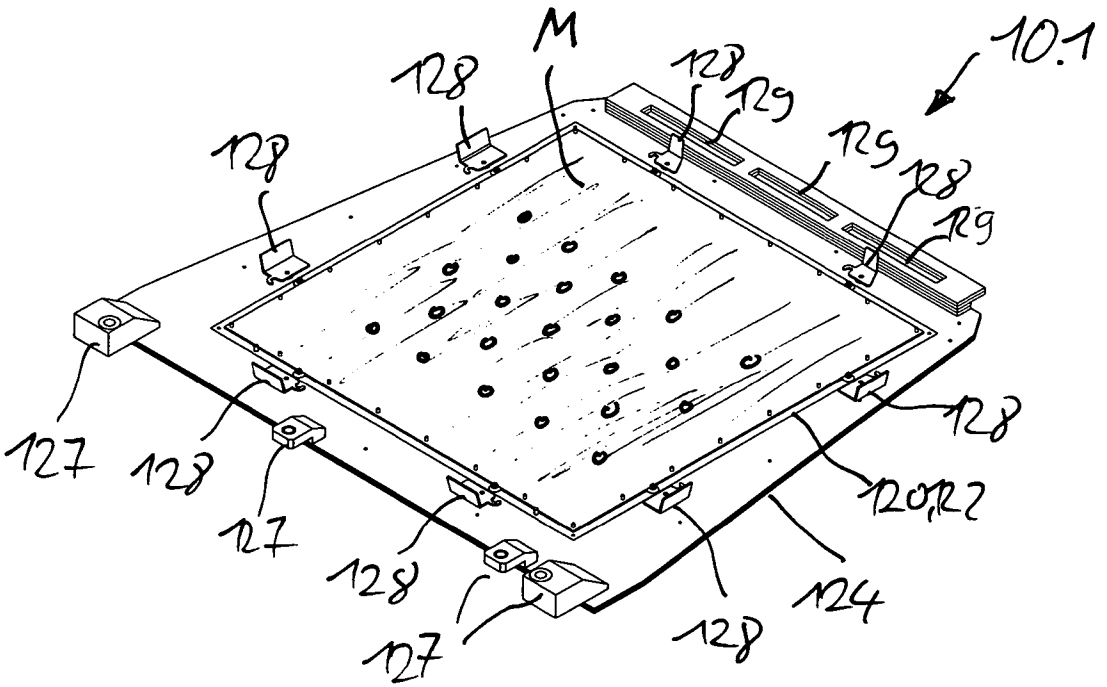
FIG. 5 shows a perspective illustration of the transport frame, as per FIG. 4, with inserted frame apparatus, as per FIG. 3.

Furthermore, FIG. 4 illustrates a known transport frame 124 which is used, for example, in sewing machines and is referred to as a holder for material to be sewn. This transport frame 124 comprises connection units 127, 128, 129 in order to be able to be mounted securely in a sewing machine.

Figure 3:
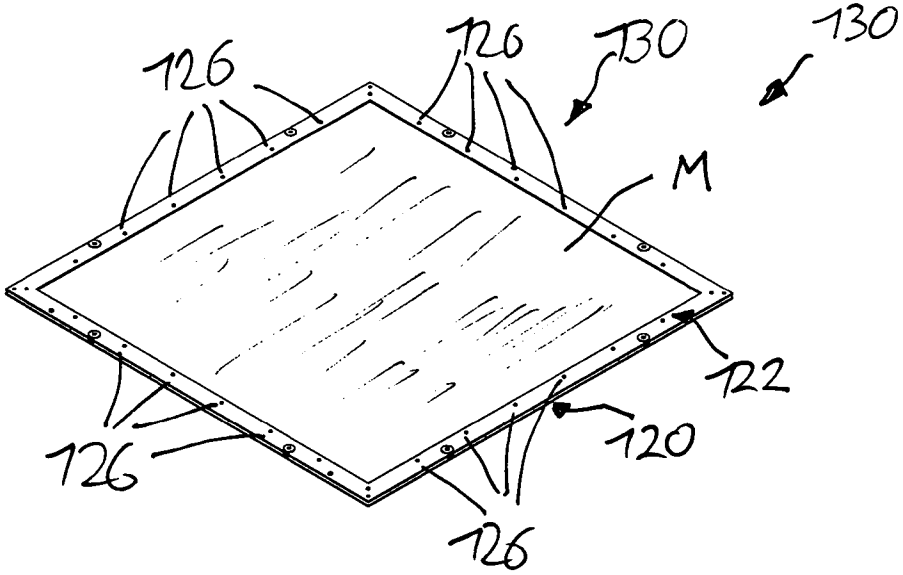
FIG. 3 shows a perspective illustration of a frame apparatus with changeable frame and cover frame and clamped material unit.

Furthermore, the transport frame 124 has an insert inner contour 132, the profile of which corresponds to the outer contour profile of the frame apparatus 130 as per FIG. 3. The frame apparatus 130 with a material unit M which already has a punching/perforation pattern is inserted into this insert inner contour 132 and can then be further processed, for example for production of decorative seams on the material unit M, in the sewing machine without any further modifications.

Figure 6:
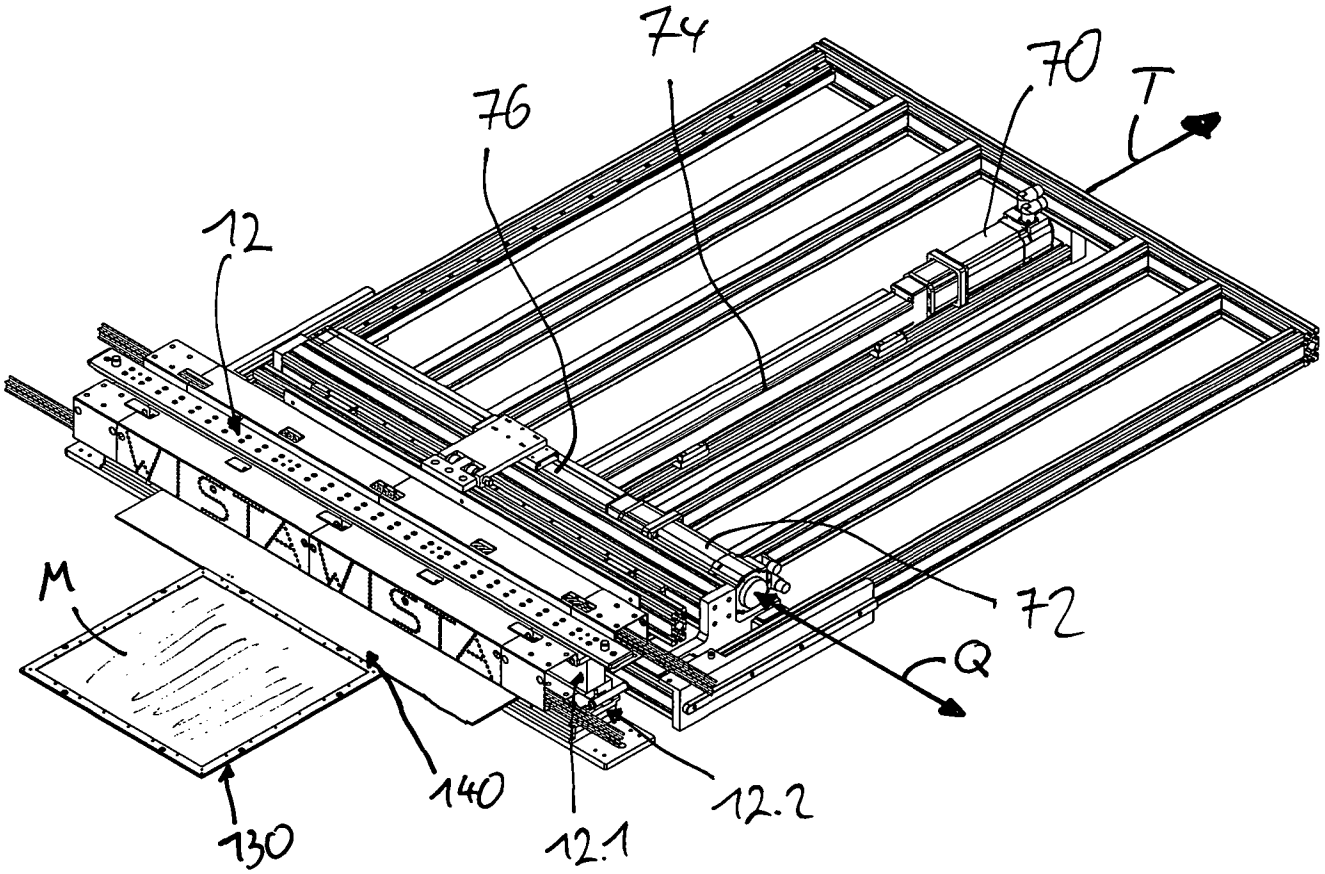
FIG. 6 shows a perspective illustration of a detail of the punching/perforating tool of a punching/perforating machine with queued or supplied frame apparatus, as per FIG. 3, with additional two servomotors which can displace the frame apparatus, during the punching/perforation operation of the material unit, into a predefinable position in the transport direction and/or in the transverse direction.

FIG. 6 shows a perspective of a detail of a punching/perforating machine 10 with a punching/perforation tool 12 having a tool upper part 12.1 and a tool lower part 12.2. A frame apparatus 130 with an unpunched or unperforated material unit M, as per FIG. 3, is queued in front of the punching/perforation tool 12 and is connected to a frame accommodation/connection device 140. The frame apparatus 130 is supplied between the tool upper part 12.1 and the tool lower part 12.2. The punching/perforation tool 12 then cyclically carries out the corresponding punching or perforation. Prior to each punching/perforation cycle, the frame apparatus 130 with material unit M is moved in the transport direction T and possibly also in the transverse direction Q depending on the punching/perforation pattern to be produced. For this purpose, a first drive unit 70 and a second drive unit 72 are present, which are both formed for example as servomotors. The first drive unit 70 enables a movement of the frame apparatus 130 in the transport direction T, and the second drive unit 72 enables a displacement of the frame apparatus 130 in the transverse direction Q. Both drive units 70, 72 are connected via corresponding coupling members 74, 76 to the frame accommodation/connection device 140 or the frame apparatus 130.

The drive units 70, 72 are actuated via a control device which is not illustrated in any more detail in FIG. 6.

The individual sequences in the production of the punching/perforation pattern, and the further components of a punching and perforating machine, are described below with reference to FIGS. 7, 8 and 9.

Figure 8:
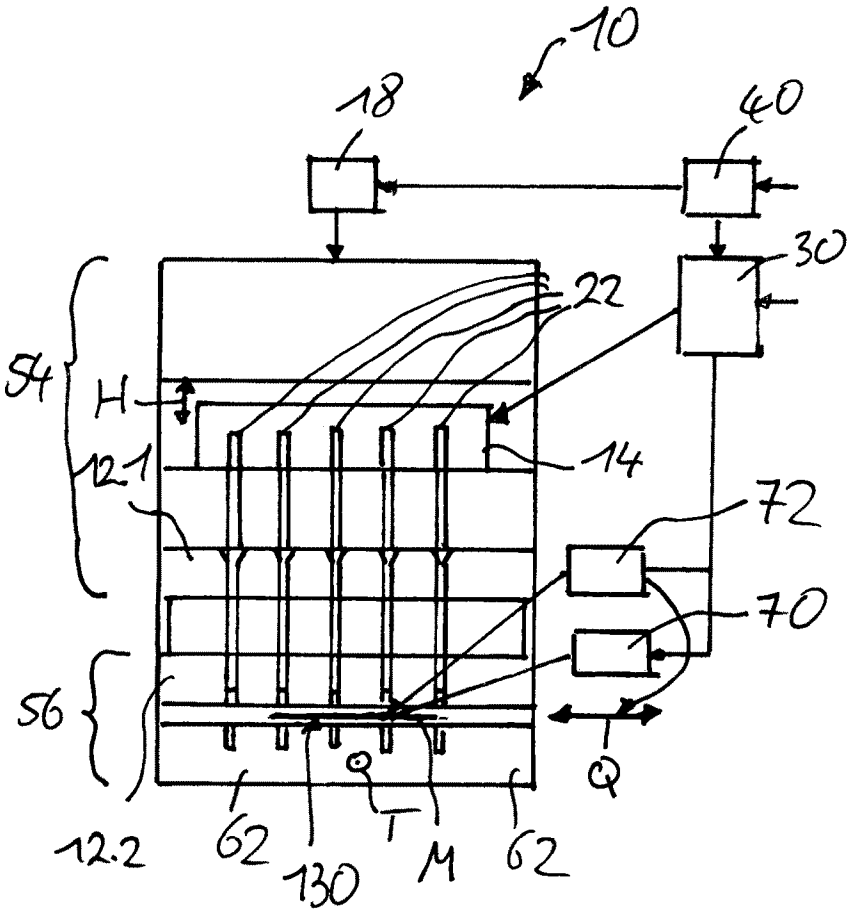
FIG. 8 shows a highly schematized illustration of a punching/perforating machine, as per FIG. 7, in a view as seen in the transport direction.
Figure 7:
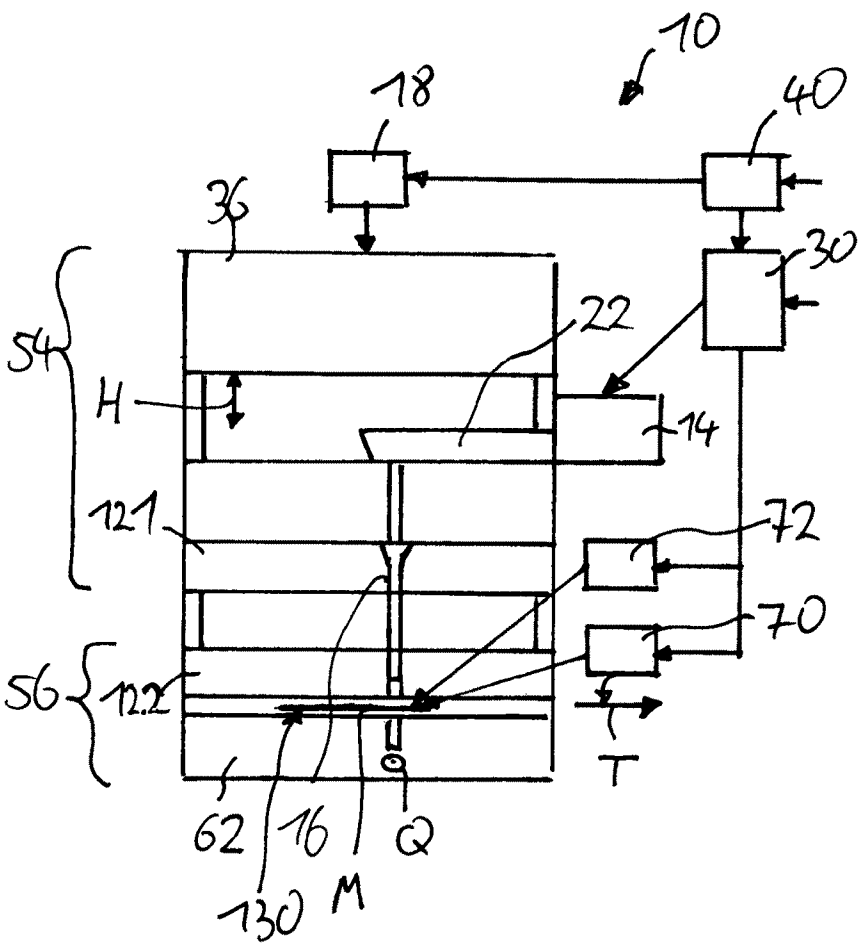
FIG. 7 shows a highly schematized illustration of a punching/perforating machine with means for displacing a supplied frame apparatus with the material unit in the transport direction and/or transverse direction in a view as seen in the transverse direction.

A punching/perforating machine 10, which is illustrated in highly schematized form in FIGS. 7 and 8, comprises a machine upper part 54 and a machine lower part 56. In the machine upper part 54, a pressure beam 36 which is acted on by a drive unit 18 for generation of a punching/perforation stroke H is arranged on the top side. Below the pressure beam 36, and spaced apart, is a tool upper part 12.1 of a punching/perforation tool 12, in which stamping punches/perforating needles 16 are arranged.

Present between the pressure beam 36 and the punching/perforation tool 12 are blocking slides 22 which are connected to a control block 14. The blocking slides 22 are of extendable and retractable form and assigned in each case to a stamping punch or a perforating needle 16. In the extended state, as illustrated in FIG. 7, the associated stamping punch/perforating needle 16 is activated, such that a supplied material unit M is perforated during execution of the punching/perforation stroke H. The material unit M is clamped within the frame apparatus 130.

The machine lower part 56 comprises, on the top side, a tool lower part 12.2 of the punching/perforation tool 12, in which the stamping punch/the perforating needle 16 are guided, for example. Spaced apart on the bottom side is a base plate 62. The frame apparatus with material unit M is supplied between the tool lower part 12.2 of the punching/perforation tool 12 and the base plate 62. The transport direction of the material unit M is denoted in FIG. 7 by the reference designation T.

Furthermore, a memory device 40 is present, in which all the data concerning the geometry of the patterns to be perforated or to be punched in the material unit M is stored, such as for example position and diameter of the perforation/punching apertures. The memory device 40 is communicatively connected to a control device 30, wherein the control device 30 actuates the punching/perforating machine 10 in dependence on the data stored in the memory device 40. For instance, the control device activates the drive unit 18 for activation of the punching/perforation stroke H. Furthermore, the control device 30 is communicatively connected to a first drive unit 70 and a second drive unit 72. The first drive unit 70 acts on the material unit M, in such a way that when the first drive unit 70 is activated, the material unit M carries out a movement in the transport direction T to a predefinable extent. Furthermore, the second drive unit 72 also acts on the material unit M, in such a way that when the second drive unit 72 is activated, the material unit M carries out a displacement in the transverse direction Q (see FIG. 8) to a predefinable extent. The activation of the displacement of the material unit M prior to each punching/perforation stroke H is initiated by the control device 30, which uses information retrieved from the memory device 40 as a basis for determining the extent of the displacement of the material unit M in the transport direction T and/or in the transverse direction Q for the respective punching/perforation stroke H.

Figure 9:
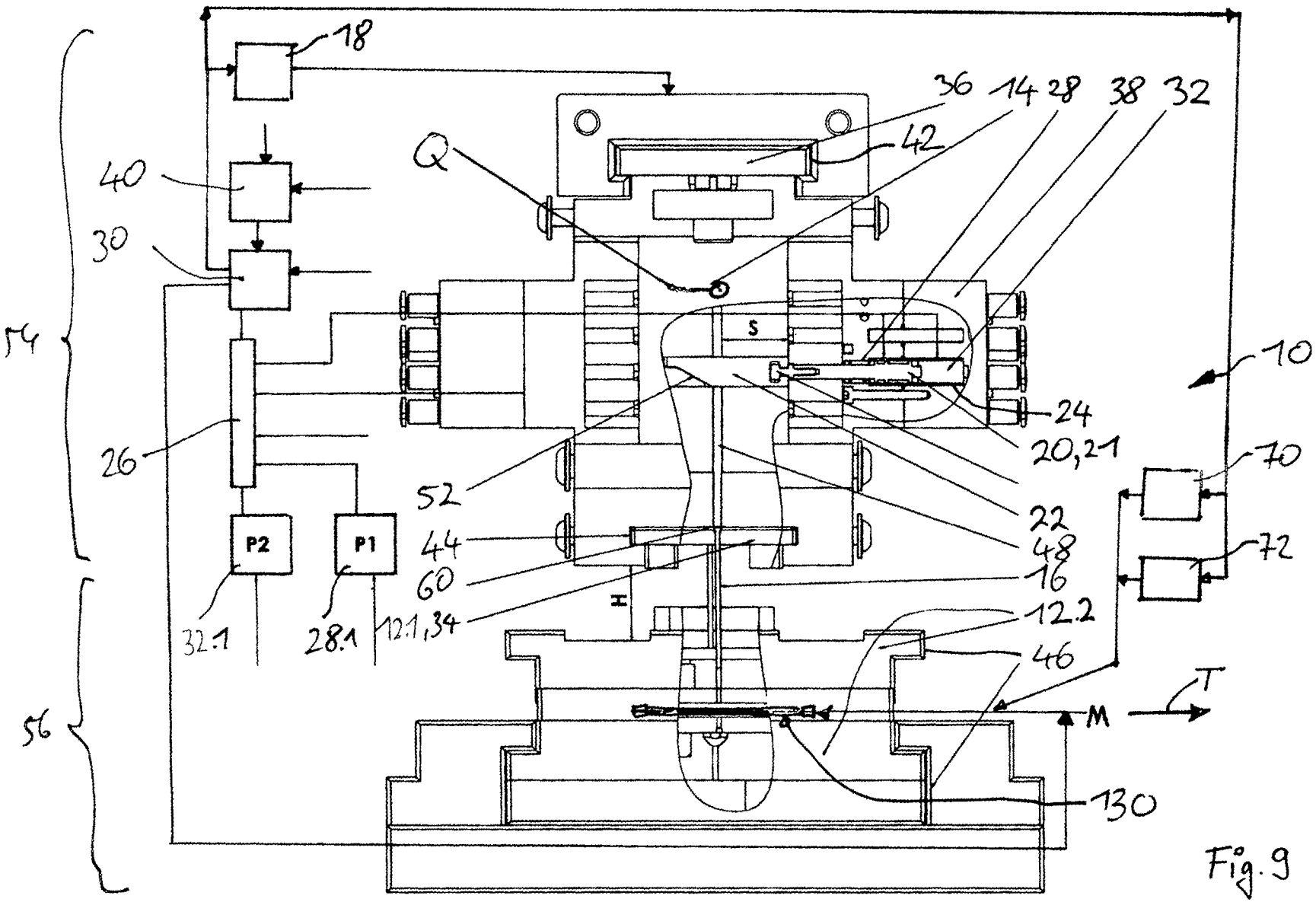
FIG. 9 shows a highly schematized illustration of a punching/perforating machine, as per FIG. 7, with additionally illustrated design details, FIGS. 10 *a-d* show a schematized illustration of possible punching/perforation patterns using a punching/perforating machine as per FIGS. 7 to 9.

The punching/perforating machine 10 illustrated in schematized form in FIG. 9 represents an exemplary design embodiment—also partially in a highly schematized illustration—of the punching/perforating machine 10 as per FIGS. 7 and 8. Identical components bear the same reference designations and are not explained again.

The punching/perforating machine 10 comprises a punching/perforation tool 12 with a tool upper part 12.1, a tool lower part 12.2 and a control block 14. In the punching/perforating machine 10 which is driven by a servo-hydraulic system, the control block 14 is connected to a pressure beam 36, that is to say introduced in a control block guide groove 42 present on the pressure beam 36 and centered. A drive unit 18 moves the pressure beam 36 upward and downward in the stroke direction H. Located under the control block 14 is the corresponding tool upper part 12.1 of the punching/perforation tool 12, said tool upper part having a grid arrangement for the perforating needles 16 that is identical to that of the control block. The tool upper part 12.1 of the punching/perforation tool 12 comprises a needle holder 34 which is introduced in a needle holder guide groove 44 in the control block. The tool lower part 12.2 of the punching/perforation tool 12 having the female dies is centered by means of a centering pin (not illustrated in any more detail). This tool lower part 12.2 of the punching/perforation tool 12 is also placed in a tool guide groove 46. The needle holder 34 forms, together with the needle guide which is fixedly connected to the punching/perforation tool 12, a unit, namely the punching/perforation tool 12.

Located on the needle holder 34 is a spacer plate 60 which, firstly, facilitates the disassembly of the punching/perforation tool 12 and, secondly, permits the use of further standard tools with the same tool profile but different pitch. Here, the open spacer plate 60, which is provided with grid holes, is replaced by a closed variant without grid holes.

The perforating needles 16 are arranged in a predefined grid in the transverse direction Q, which runs perpendicularly to the plane of the illustration of FIG. 9. The perforating needles 16 can either be activated or deactivated individually during each punching/perforation stroke H. This individual actuation is implemented in that a control device 30 is present, which is communicatively connected to a memory device 40 in which the geometrical data of the punching/perforation pattern to be created on a material unit M supplied to the punching/perforation tool 12 is stored.

The control device 30 is communicatively connected to a valve device 26, wherein the valve device 26 comprises valve units which are each individually communicatively connected to piston-cylinder units arranged on the control block 14. The piston-cylinder units are formed as double-acting piston-cylinder units, having a cylinder 24, a piston 21 and a piston rod 20. A first pressure chamber 28 and a second pressure chamber 32 are present in each piston-cylinder unit.

Each piston rod 20 is connected, in its free end region, to a blocking slide 22, which is displaceable in the sliding direction S transversely to the stroke direction H from an activation position (extended state) and a deactivation position (retracted state) when corresponding pressure is applied to the piston-cylinder unit. Furthermore, a first pressure accumulator 28.1 and a second pressure accumulator 32.1 are present, which communicate with the valve device 26. The first pressure chamber 28 provides a pressure P1, and the second pressure chamber 32 provides a pressure P2, which is higher than the pressure P1.

Each perforating needle 16 is assigned a blocking slide 22 with associated actuable piston-cylinder unit. The blocking slide 22 is spaced apart from the upper head end of the perforating needle 16. Below the blocking slide 22, an extension profile 48 is present in the control block 14 in a corresponding guide, wherein the bottom side of the extension profile 48 bears on the head of the assigned perforating needle 16, and the upper end side of the extension profile 48 is arranged at the height level of the bottom side of the blocking slide 22. In the extended state of the blocking slide 22, the latter rests on the extension profile 48 such that when the stroke movement H of the control block 14 is carried out, the perforating needle 16 is moved downward and triggers a perforation on the material unit M.

In the case of a retracted blocking slide 22, there is no contact between the extension profile 48 and the blocking slide 22 since the bottom side of the blocking slide 22 is beside the bottom side of the extension profile 48. If a punching/perforation stroke is carried out in the retracted position of the blocking slide 22, the extension profile 48 has no movement applied to it by the blocking slide 22, such that the assigned perforating needle 16 does not carry out a perforation.

The blocking slide 22 has, in its free end region, a contour 52 which runs at an angle to the punching/perforation stroke direction H and which ensures that if the extension profile 48 or the perforating needle 16 protrudes upward when the blocking slide 22 is being extended, the extension profile 48 is pushed downward and is not sheared off or damaged. As a result, permanently reliable functionality is ensured.

During operation of the punching/perforating machine, the first pressure chamber 28 and second pressure chamber 32 are actuated individually as follows via the valve device 26 and the control device 30, taking account of the stored punching/perforation pattern data. The first pressure chamber 28 has the pressure P1 applied permanently via the first pressure accumulator 28.1, that is to say, under the action of the pressure P1, the blocking slide 22 is in the retracted position such that when the punching/perforation stroke H is carried out, the assigned perforating needle 16 does not carry out a perforation.

If a perforating needle 16 is to be activated during a punching/perforation stroke H, the control device 30 causes the valve device 26 to apply the pressure P2 to the second pressure chamber 32 via the second pressure accumulator 32.1, said pressure P2 being higher than the permanently present pressure P1 in the first pressure chamber 28, such that the blocking slide 22 moves out and, when the punching/perforation stroke H is carried out, the assigned perforating needle 16, in conjunction with the extension profile 48, carries out a punching/perforation stroke H and produces a perforation on the material unit M.

On the control block 14 there are thus individually actuated piston-cylinder units which are under a permanent first pressure P1 which, so to speak, forms an air spring on the return stroke, wherein for each perforating needle 16 to be actuated in the punching/perforation tool 12, a piston rod 20 of the corresponding piston-cylinder unit is assigned and is activated, that is to say extended, by application of the pressure P2.

As a result of the mutually separated structure of control block 14 and punching/perforation tool 12 in conjunction with the piston-cylinder units arranged offset in the stroke direction H and in the transverse direction Q within a housing 38, it is possible to achieve a minimum spacing with respect to the grid size between the perforating needles 16 in the tool 12, which corresponds for example to a standard perforation in automobile construction. From this, for example a maximum number of 1024 needles with a perforation width of 1.9456 mm can be achieved.

This high number of needles per unit area cannot be achieved in the known systems.

As already described above, the extension profile 48 is arranged between the head of the individual perforating needles 16 and blocking slides 22. The extension profile 48 consists, for example, of a hardened round material with a stepped diameter, which rests loosely on the head of the perforating needle 16. The stepped outer diameter prevents any movement of the vertically installed extension profile 48 in the control block 14 during installation or removal of the tool. At the same time, the extension profile 48 is retained in a fixedly defined position above the needle head by this step.

In order to compensate for the difference between the predefined needle diameter or needle spacing and the necessarily wider blocking slide 22 with the associated piston rod 20, these mechanical extension profiles 48 are inserted with different lengths in the control block 14 and assigned accordingly to the blocking slides 22.

The individual piston-cylinder units are present on both sides of the control block 14 as special cylinders and are actuated individually by control valves 26. These special cylinders are arranged within the machine, for example in housings 38 each having four piston-cylinder units, in order to protect them against damage or access. These housings 38 contain the complete electronic and pneumatic actuation system (valve terminals, pressure regulators, pressure monitoring, etc.). These housings 38 are connected by means of a coupling system constructed for this purpose to the valve device 26 with its individually assigned control valves. Alternatively, however, the control valves of the valve device 26 can also be mounted flexibly on appropriate transport frames, in order to use same on different punching machines. As a result, there is no restriction to only one working area.

As a result of the permanently present counter-pressure P1 in the return stroke of the piston rod 20 of the piston-cylinder units, the switching time between the punching operations can be reduced greatly. This results in a substantially higher cycle rate (for example 160 to 180 per minute) of the punching unit compared with the known punching/perforating machines.

Furthermore, a first drive unit 70 and a second drive unit 72 are illustrated, also in highly schematized form, in FIG. 9. These two drive units 70, 72 are actuated and activated or deactivated by the control device 30 prior to each punching/perforation stroke H. The first drive unit 70, which is formed for example as a servomotor, is connected via coupling members (not illustrated in any more detail in FIG. 9) to the frame apparatus 130 with material unit M. The second drive unit 72, which is formed for example as a servomotor, is likewise connected via coupling members (not illustrated in any more detail in FIG. 9) to the frame apparatus 130 with material unit M. When the first drive unit 70 is activated by the control device 30 in dependence on the data stored in the memory device 40, the frame apparatus 130 with material unit M carries out a displacement in the transport direction T to the respectively currently predefined extent. When the second drive unit 72 is activated by the control device 30, the frame apparatus 130 with material unit M carries out a movement in the transverse direction Q to the respectively currently predefined extent.

By virtue of the fact that the frame apparatus 130 with material unit M can be arranged relative to the punching/perforation tool 12 both in the transport direction T and in the transverse direction Q individually for each punching/ perforation stroke H, virtually any desired punching/perforation patterns can be generated.

Figure 10:
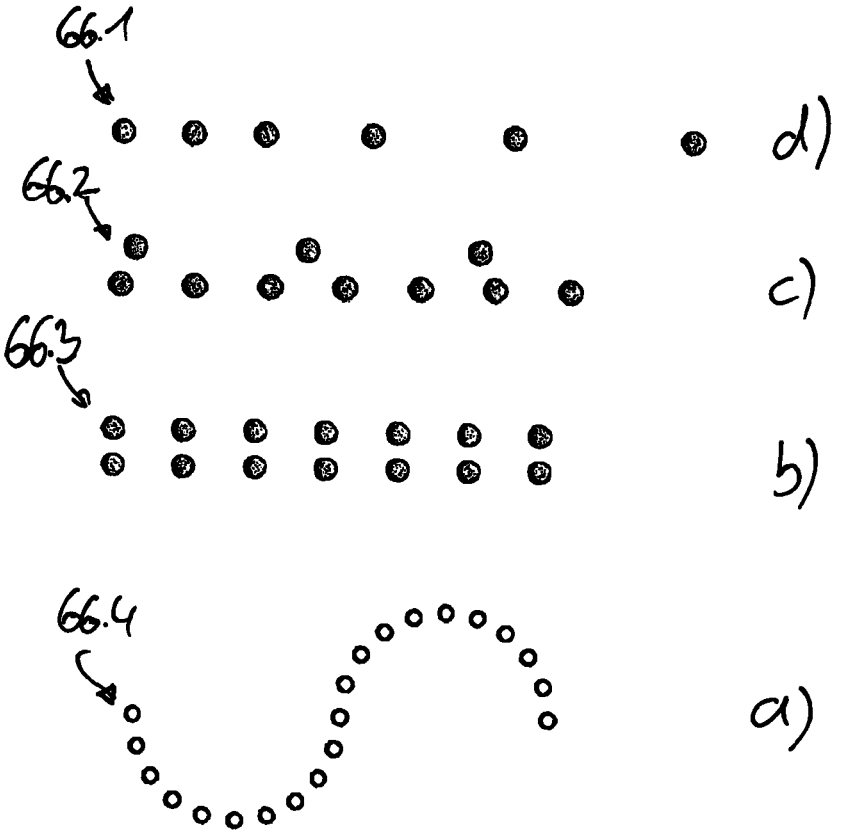

Punching/perforation patterns are indicated, by way of example, in FIGS. 10*a, b, c* and *d*. In principle, the displaceability of the frame apparatus 130 with material unit M makes it possible to place the holes in any desired manner.

Figure 11:
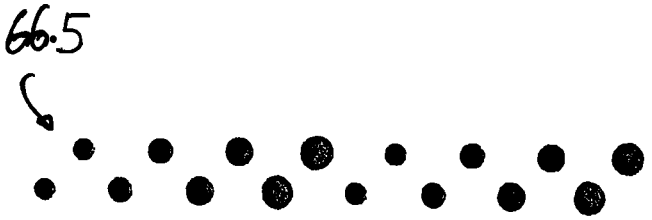
FIG. 11 shows a schematic illustration of a perforation pattern using a punching/perforating machine as per FIGS. 7 to 9 which comprises stamping punches/perforating needles having different hole diameters.

As illustrated in FIG. 11, different hole diameters can also be generated by means of perforating needles 16 of different diameter which are arranged in the punching/perforation tool 12 and by corresponding displacement of the frame apparatus 10 with material unit M. Prior to the respective punching/perforation stroke H, software is used to determine the perforating needles of corresponding diameter that are closest to the perforation position and to displace the material unit M by the corresponding extent.

The mechanical structure of the punching/perforation tool 12 described by way of example makes it possible, as a function of the system, to perform any desired advancing movements in the transport direction T and in the transverse direction Q by coupling the frame apparatus 130 with material unit M to the first and second drive units 70, 72. As a result, there is, inter alia, the possibility of also producing curved and circular contours (see, for example, FIG. 10*a*). Overall, there are virtually unlimited possibilities for the representation of punching/perforation patterns according to any desired design. It is necessary merely for the corresponding data files containing the information about the geometry of the punching/perforation pattern, in particular in terms of the position and size, to be read into the memory device 40.

Figure 12:
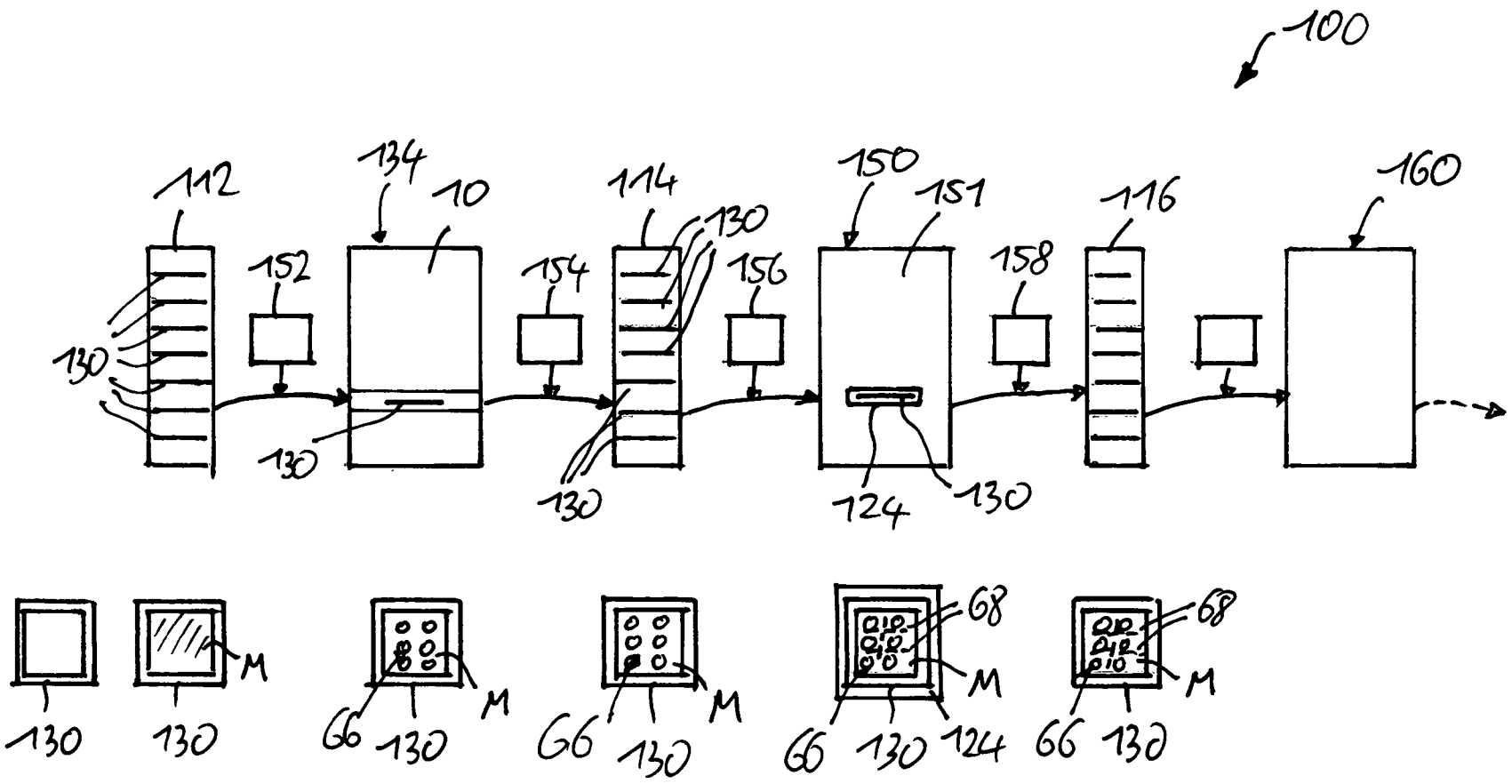
FIG. 12 shows a schematic illustration of a processing installation of several processing stations, which are supplied, in each case from intermediate stores, with frame apparatuses with material units for processing purposes, with processing states of the material unit within the frame apparatus being illustrated underneath.

In FIG. 12, an exemplary embodiment of a processing installation 100 is illustrated in highly schematized form, which shows the use of the frame apparatus 130 in various processing operations.

In this case, there is a first processing station 134 which is formed as a punching/perforating machine 10. Connected downstream of the first processing station 134 is a second processing station 150 which is, for example, a sewing machine 151. There may also be a further processing station 160 after that for further processing.

Connected upstream of the first processing station 134 is a first intermediate store 112 in which individual frame apparatuses 130, each with a clamped material unit M having no punching/perforation pattern, are stored.

The frame apparatuses 130 are individually removed from this first intermediate store 112 and supplied to the perforation machine 10, which generates a punching/perforation pattern 66 in the material unit M. Thereafter, the frame apparatus 130 with perforated/punched material unit is stored in a second intermediate store 114. The frame apparatuses 130 are then removed from the second intermediate store 114 and supplied to the second processing station 150 or the sewing machine 151 and, in this case, inserted into a transport frame 124 (holder for material to be sewn). The sewing machine 151 then produces, for example, decorative seams 68 on the punched/perforated material unit M. The thus processed material unit M together with the frame apparatus 130 is then stored in a third intermediate store 116 and can be removed for processing in a further processing station 160.

The frame apparatuses 130 can be removed from the intermediate stores 112, 114, 116 for example by means of handling units 152, 154, 156, 158, which are illustrated in highly schematized form in FIG. 12 and which also remove the processed frame apparatus 130 from the processing stations 134, 150 for storage in the intermediate stores 114, 116.

The handling units 152, 154, 156, 158 may for example be robot units which are equipped with corresponding gripper units.

The illustrated processing installation 100 can be used to implement economical, automatic and reliable processing (punching, embossing, sewing or the like) of material such as for example leather, synthetic leather, films, paper or the like, for example in the automotive industry and paper processing. With the illustrated solutions, a material unit to be processed can, with the aid of the frame apparatus, be punched, embossed, sewn, or the like, in any form whatsoever with a high level of accuracy. The frame apparatus can be designed in a variable manner such that it can be used in different machines (punching/perforating, embossing and sewing machines, and the like).

The invention claimed is:

1. A punching/perforating machine (10) for generating a predefinable punching/perforation pattern in a material unit (M) supplied in a transport direction (T), comprising a punching/perforation tool (12) having a tool upper part (12.1), which is movable in a stroke direction (H) and which has a plurality of stamping punches/perforating needles (16) which are arranged in a predefined grid in a transverse direction (Q) and which are movable by a pressure beam (36) which is operatively connected via a control device (30) to a drive unit (18) for generating a punching/perforation stroke (H), and a stationary tool lower part (12.2)/female die, wherein the material unit (M) is supplied between the tool upper part (12.1) and the tool lower part (12.2), wherein the material unit (M) is arranged or clamped in a frame apparatus (130), wherein the punching/perforating machine (10) comprises a frame accommodation/connection device (140) for accommodation/for connection of the frame apparatus (130), wherein the frame apparatus (130) with the material unit (M) is supplied between the tool upper part (12.1) and the tool lower part (12.2) for perforation/punching of the material unit (M).

2. The punching/perforating machine as claimed in claim 1, wherein the frame apparatus (130) comprises a changeable frame (120) having fixing units (26) for connecting or clamping an edge region of the material unit (M) in the changeable frame (120).

3. The punching/perforating machine as claimed in claim 2, wherein the frame apparatus (130) comprises a cover frame (122) which is arranged on/connected to the changeable frame (120) to secure the connection of the edge region of the material unit (M).

4. The punching/perforating machine as claimed in claim 1, wherein means (70, 72) for generating a simultaneous relative movement of the frame apparatus (130) with material unit (M) relative to the punching/perforation tool (12) to a predefinable extent both in the transport direction (T) and in the transverse direction (Q) are present, such that the frame apparatus (130) with material unit (M) is positionable, prior to each punching/perforation stroke (H), in an individual predefinable position relative to the punching/perforation tool (12).

5. The punching/perforating machine as claimed in claim 4, wherein the means (70, 72) comprise a first drive unit (70), which brings about a movement of the frame apparatus (130) with material unit (M) in the transport direction (T), and a second drive unit (72), which brings about the movement of the frame apparatus (130) with material unit (M) in the transverse direction.

6. The punching/perforating machine as claimed in claim 5, wherein the first drive unit (70) and the second drive unit (72) are each formed as a servomotor.

7. The punching/perforating machine as claimed in claim 5, wherein the drive units (70, 72) are connected via coupling members to the frame apparatuses (130) with material unit (M).

8. The punching/perforating machine as claimed in claim 4, further comprising a memory device (40), in which data for a geometry of the punching/perforation pattern with respect to position and diameter is stored, wherein the control device (30) is communicatively connected to the memory device (40), wherein the control device (30) is operatively connected to a control block (14) of the stamping punches/perforating needles (16) for actuation/activation/deactivation of the stamping punches/perforating needles (16) during a punching/perforating operation, wherein the control device (30) is communicatively connected to the means (70, 72) for generating a simultaneous relative movement of the material unit (M) and wherein the control device (30) initiates the corresponding activation of the means (70, 72) in dependence on the data stored in the memory device (40).

9. The punching/perforating machine as claimed in claim 1, wherein the punching/perforation tool (12) comprises stamping punches/perforating needles (16) having different diameters.

10. The punching/perforating machine as claimed in claim 1, further comprising:

a control block (14), which comprises piston-cylinder units whose movements during the punching/perforation stroke are individually actuable via the control device (30) and are individually assigned to each stamping punch/each perforating needle (16); and a blocking slide (22), which is connected in each case to a corresponding piston rod (20) of the piston-cylinder unit, wherein the blocking slide (22) is displaceable into an activation or deactivation position by the movement of the piston rod (20), wherein, in the activation position, the blocking slide acts directly or indirectly on the stamping punch/the perforating needle (16) during execution of the stroke (H), wherein, in the deactivation position, the blocking slide does not exert any action on the stamping punch/the perforating needle (16), such that, in the activation position of the blocking slide (22), the blocking slide (22) acts on the stamping punch/perforating needle (16) during the stroke (H) and a perforation is carried out and, in the deactivation position of the blocking slide, no punching/perforation of the material unit (M) is effected.

11. The punching/perforating machine as claimed in claim 10, wherein the piston-cylinder unit is formed as a double-acting piston-cylinder unit having a first pressure chamber (28) and a second pressure chamber (32), wherein a first pressure (P1) is applied permanently to the first pressure chamber (28) via the control device (30) and has the effect that the blocking slide (22) is located or retained in the deactivation position and, when carrying out punching or perforation, the control device (30) applies a second pressure (P2), which is higher than the first pressure (P1), to the second pressure chamber (32) when activated, such that the blocking slide (22) moves out into the activation position and, as a result, during the stroke (H), this movement is transmitted to the associated stamping punch/perforating needle, such that punching or perforation of the material unit (M) is carried out.

12. A punching/perforating machine (10) for generating a predefinable punching/perforation pattern in a material unit (M) supplied in a transport direction (T), comprising a punching/perforation tool (12) having a tool upper part (12.1), which is movable in a stroke direction (H) and which has a plurality of stamping punches/perforating needles (16) which are arranged in a predefined grid in a transverse direction (Q) and which are movable by a pressure beam (36) which is operatively connected via a control device (30) to a drive unit (18) for generating a punching/perforation stroke (H), and a stationary tool lower part (12.2)/female die, wherein the material unit (M) is supplied between the tool upper part (12.1) and the tool lower part (12.2), wherein the material unit (M) is arranged or clamped in a frame apparatus (130), wherein the punching/perforating machine (10) comprises a frame accommodation/connection device (140) for accommodation/for connection of the frame apparatus (130), wherein the frame apparatus (130) with the material unit (M) is supplied between the tool upper part (12.1) and the tool lower part (12.2) for perforation/punching of the material unit (M), and wherein the frame apparatus (130) comprises an electronically readable information unit which contains specific information for the respective punching/perforation pattern of the clamped material unit (M) and/or information for the further processing of the frame apparatus with material unit (M).

13. The punching/perforating machine as claimed in claim 1, wherein the frame apparatus has a rectangular peripheral contour.

14. A processing installation (100) for standardized processing of material units (M), comprising:

a punching/perforating machine (10) for generating a predefinable punching/perforation pattern in a material unit (M) supplied in a transport direction (T), comprising a punching/perforation tool (12) having a tool upper part (12.1), which is movable in a stroke direction (H) and which has a plurality of stamping punches/perforating needles (16) which are arranged in a predefined grid in a transverse direction (Q) and which are movable by a pressure beam (36) which is operatively connected via a control device (30) to a drive unit (18) for generating a punching/perforation stroke (H), and a stationary tool lower part (12.2)/female die, wherein the material unit (M) is supplied between the tool upper part (12.1) and the tool lower part (12.2), wherein the material unit (M) is arranged or clamped in a frame apparatus (130), wherein the punching/perforating machine (10) comprises a frame accommodation/connection device (140) for accommodation/for connection of the frame apparatus (130), wherein the frame apparatus (130) with the material unit (M) is supplied between the tool upper part (12.1) and the tool lower part (12.2) for perforation/punching of the material unit (M);

a first processing station (134), which comprises the punching/perforating machine (10), to which a respective standardized frame apparatus (130) with material unit (M) is supplied for generation of a predefined punching/perforation pattern; and a second processing station (150) to which the frame apparatus (130) with perforated/punched material unit (M) is supplied and which further processes the perforated/punched material unit (M).

15. The processing installation as claimed in claim 14, wherein the second processing station (150) comprises a sewing machine (151) having a transport frame (124)/holder for material to be sewn, into which the frame apparatus (130) with perforated material unit (M) is introduced, and the material unit (M) is provided with decorative seams and/or connection seams.

16. The processing installation as claimed in claim 15, wherein at least one further processing station (160) is present, by which the frame apparatuses (130) with processed material unit (M) coming from the second processing station (150) are subjected to further processing.

17. The processing installation as claimed in claim 14, further comprising a first intermediate store (112), which is arranged upstream of the first processing station (134) and in which frame apparatuses (130) with material units (M) which have not yet been perforated/punched are stored, which are successively supplied to the first processing station (134).

18. The processing installation as claimed in claim 17, further comprising a second intermediate store (114), which is connected downstream of the first processing station (134) and in which frame apparatuses (130) with material units (M) which have been provided with a punching/perforation pattern are stored, which are successively supplied to the second processing station.

19. The processing installation as claimed in claim 18, further comprising a third intermediate store (116) is present, which is connected downstream of the second processing station (150) and in which the frame apparatuses (130) with processed material unit (M) are stored, which are successively supplied to a further processing station (160) for further processing.

20. The processing installation as claimed in claim 19, further comprising controllable handling units (152, 154, 156, 158), which remove the frame apparatuses (130) from the intermediate stores (112, 114, 116) and supply them to the processing stations and, after processing, deposit them into the corresponding intermediate stores (114, 116).

* * * * *